US008369759B2

(12) United States Patent
Nakamura et al.

(10) Patent No.: US 8,369,759 B2
(45) Date of Patent: Feb. 5, 2013

(54) TRANSFER APPARATUS AND IMAGE FORMING APPARATUS

(75) Inventors: Masahide Nakamura, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 177 days.

(21) Appl. No.: 12/849,513

(22) Filed: Aug. 3, 2010

(65) Prior Publication Data

US 2011/0033213 A1 Feb. 10, 2011

(30) Foreign Application Priority Data

Aug. 7, 2009 (JP) ..... 2009-184361

(51) Int. Cl.
*G03G 15/20* (2006.01)

(52) U.S. Cl. ..... 399/313

(58) Field of Classification Search ..... 399/57, 399/121, 297, 302, 313
See application file for complete search history.

(56) References Cited

U.S. PATENT DOCUMENTS

| | | | | |
|---|---|---|---|---|
| 3,443,808 | A * | 5/1969 | Siebke | 271/82 |
| 7,587,158 | B2 * | 9/2009 | Pargett et al. | 399/302 |
| 2004/0009012 | A1 * | 1/2004 | Kwak | 399/237 |
| 2009/0190979 | A1 * | 7/2009 | Tanaka | 399/397 |

FOREIGN PATENT DOCUMENTS

JP 2001-166611 A 6/2001

* cited by examiner

*Primary Examiner* — Walter L Lindsay, Jr.
*Assistant Examiner* — Frederick Wenderoth
(74) *Attorney, Agent, or Firm* — Global IP Counselors, LLP

(57) ABSTRACT

A transfer apparatus includes a transfer belt being configured to carry an image, a transfer roller having an elastic layer and being configured to transfer the image from the transfer belt onto a transfer material, and a backup roller being configured to have pressure against the transfer roller with the transfer belt therebetween in order to form a transfer nip portion. The transfer nip portion includes a pressure-contact nip and a contact nip. A length of the contact nip is smaller than half a length of the pressure-contact nip in the rotational direction of the transfer roller.

8 Claims, 9 Drawing Sheets

2×2 DOTS

8×8 DOTS

SOLID IMAGE (ONE DOT IN 1200 DPI = APPROXIMATELY 21 μm × 21 μm)
TRANSFER EFFICIENCY MEASURING PATTERN (ONE DOT IN 1200 DPI = APPROXIMATELY 21 μm × 21 μm)
IMAGE DEVIATION EVALUATION PATTERN

TRANSFER APPARATUS AND IMAGE FORMING APPARATUS

CROSS REFERENCE TO THE RELATED APPLICATIONS

This application claims priority to Japanese Patent Application No. 2009-184361 filed on Aug. 7, 2009. The entire disclosure of Japanese Patent Application No. 2009-184361 is hereby incorporated herein by reference.

BACKGROUND

1. Technical Field

The present invention relates to a transfer apparatus and an image forming apparatus which transfer an image carried by a transfer belt onto a transfer material by using a transfer belt having an elastic layer and a transfer roller having an elastic layer.

2. Related Art

In an existing electrophotographic type image forming apparatus using a liquid developer, there is a problem that transfer efficiency of an image carried by a transfer belt onto a transfer material such as transfer paper is not good. In particular, when an image which is carried by the transfer belt and on which a plurality of colors are superimposed is transferred onto the transfer material, deterioration in transfer efficiency becomes a problem.

Then, an image forming apparatus in which a long transfer nip is used for transferring has been proposed. Japanese Patent Application Publication No. 2001-166611 discloses such a nip as an example. The long transfer nip includes a pressure-contact nip which presses a transfer roller against a transfer belt and a winding nip which winds the transfer belt over the transfer roller and which is formed so as to be extremely longer than the pressure-contact nip. In the image forming apparatus, a transfer material contacts with an image with pressure on the transfer belt at the long transfer nip while a time during which a transfer bias is applied is made longer. This makes it possible to increase transfer efficiency.

However, if the long transfer nip is used and if the winding nip is long, an image transferred onto the transfer material is dragged to cause deviation at the time of transferring in some cases. The deviation of the image is considered to be caused by change in belt surface speed at the long transfer nip. In general, a surface layer portion of the transfer roller is formed to be softer than a backup roller of the transfer roller. Therefore, a surface layer portion of the transfer roller is concaved with respect to the circular circumference of the transfer roller at the pressure-contact nip and a surface of the transfer belt which carries an image is bent in the extension direction along the concave portion. On the other hand, a surface of the transfer belt is bent in the compression direction along an outer circumferential surface of the transfer roller at the winding nip. Thus, as the bending directions of the surface of the transfer belt differ at the transfer nip, the surface speed of the transfer belt changes between the pressure-contact nip and the winding nip. Then, as the winding nip is made longer, the change in the surface speed of the transfer belt is larger and image deviation tends to be caused.

An elastic layer of the transfer belt is compressed by a pressure load on the pressure-contact nip. Therefore, a net length of the belt is made short at the pressure-contact nip. On the other hand, the elastic layer of the transfer belt is hardly deformed because the pressure load is not applied to the transfer belt at the winding nip. Therefore, a difference in the surface speed of the transfer belt is caused between the pressure-contact nip and the winding nip.

Further, both of a contact area between the transfer belt and the transfer roller and a contact area between the transfer belt and the transfer material are increased by using the long transfer nip. Therefore, the transfer belt easily meanders due to a difference in the pressure load in the direction orthogonal to or substantially orthogonal to the transfer material movement direction, a position of the transfer material at the transfer nip (position different from a predetermined position), or a posture (skew) of the transfer material.

SUMMARY

An advantage of some aspects of the invention is to provide a transfer apparatus and an image forming apparatus by which excellent transfer efficiency is obtained and which can suppress deviation of the transfer image and suppress meandering of the transfer belt.

According to one aspect of the invention, there is provided a transfer apparatus. The transfer apparatus includes a transfer belt being configured and arranged to carry an image. The transfer belt has an elastic layer. The transfer apparatus also include a transfer roller having an elastic layer and being configured and arranged to transfer the image from the transfer belt onto a transfer material, and a backup roller being configured and arranged to have pressure against the transfer roller with the transfer belt therebetween. The transfer nip portion includes a pressure-contact nip formed in an area where the transfer belt is in contact with the transfer roller and the backup roller by the pressure, and a contact nip formed in an area where the transfer belt is in contact with the transfer roller and is no contact with the backup roller. A length of the contact nip in a rotational direction of the transfer roller is smaller than half a length of the pressure-contact nip in the rotational direction of the transfer roller.

BRIEF DESCRIPTION OF THE DRAWINGS

Referring now to the attached drawings which form a part of this original disclosure:

FIG. 6A is a partial enlarged view illustrating a secondary transfer portion in the same manner as in FIG. 2A. FIG. 6B is a cross-sectional view illustrating a cross section cut along a line VIB-VIB in FIG. 6A.

FIG. 8A is a view illustrating an image of 2×2 dots. FIG. 8B is a view illustrating an image of 8×8 dots. FIG. 8C is a view illustrating a solid image.

DESCRIPTION OF EXEMPLARY EMBODIMENTS

The present invention will now be described in terms of the explanatory embodiment with reference to the accompanying drawings.

Figure 1:
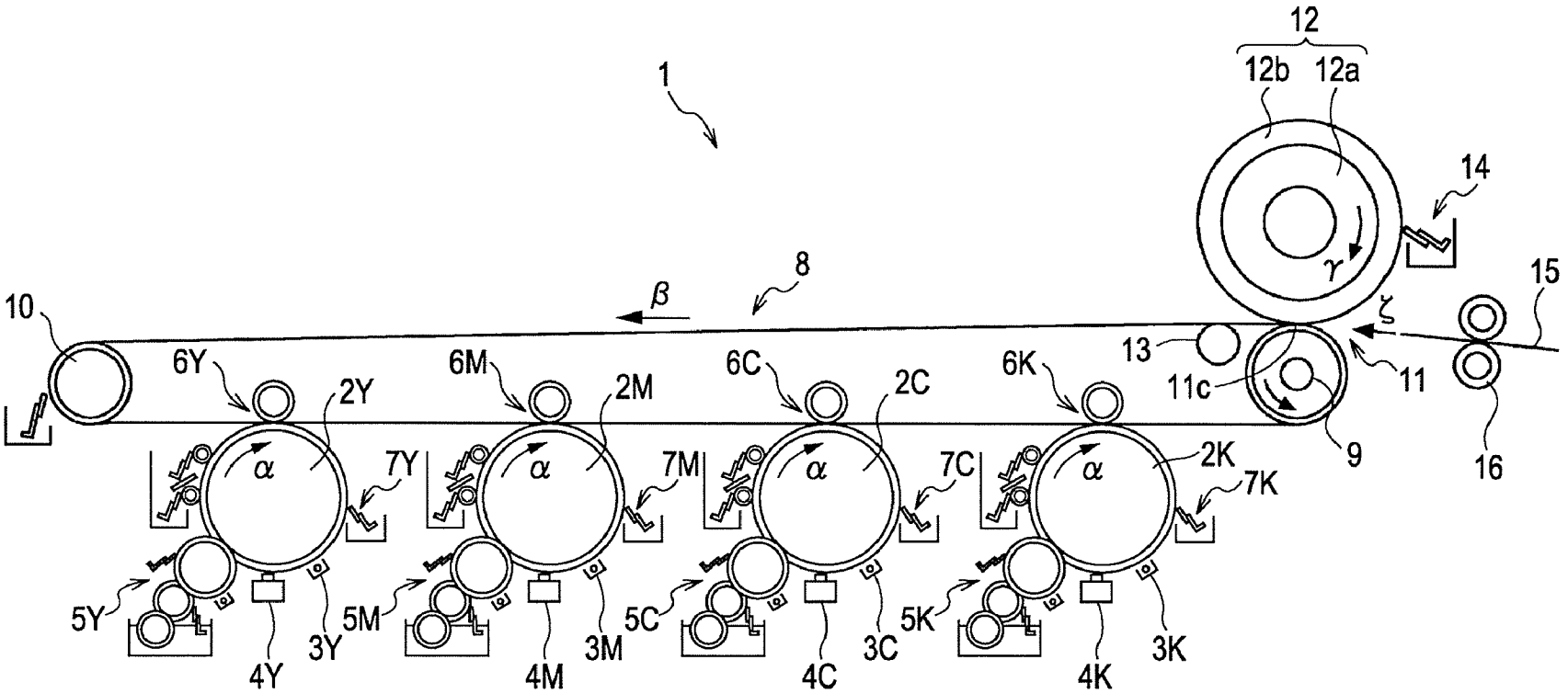
FIG. 1 is a view schematically and partially illustrating an image forming apparatus according to a first embodiment of the invention.
Figure 2A:
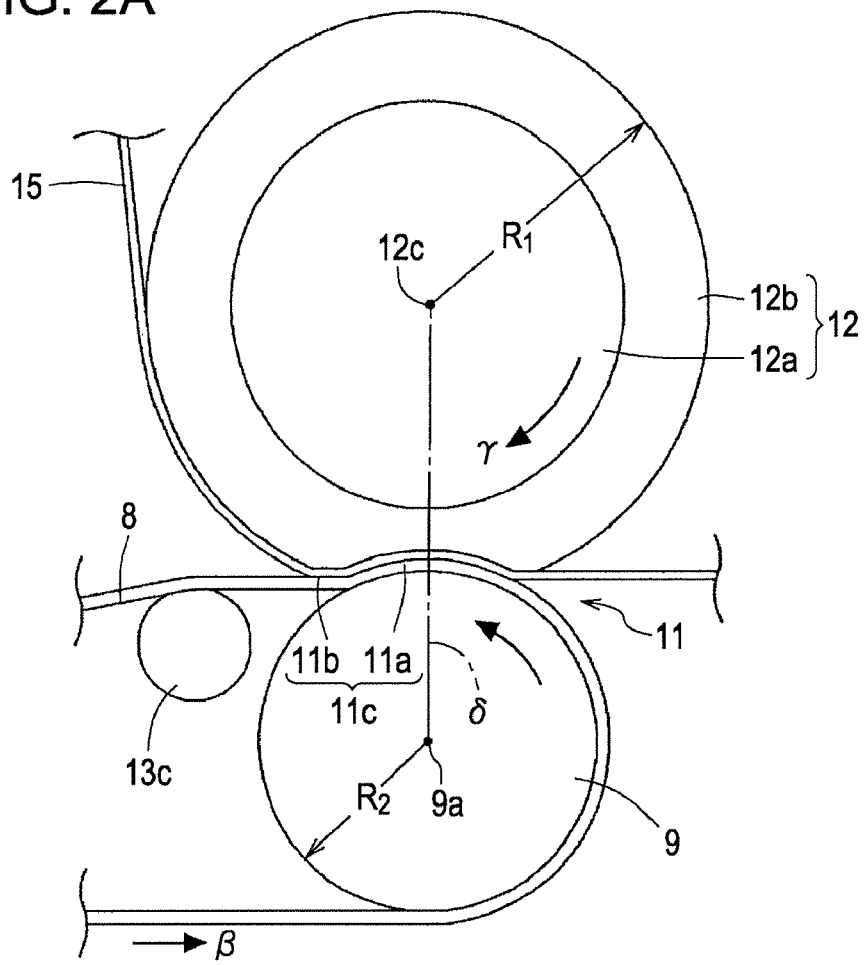
FIG. 2A is a partial enlarged view illustrating a secondary transfer portion according to the first embodiment.
Figure 2B:
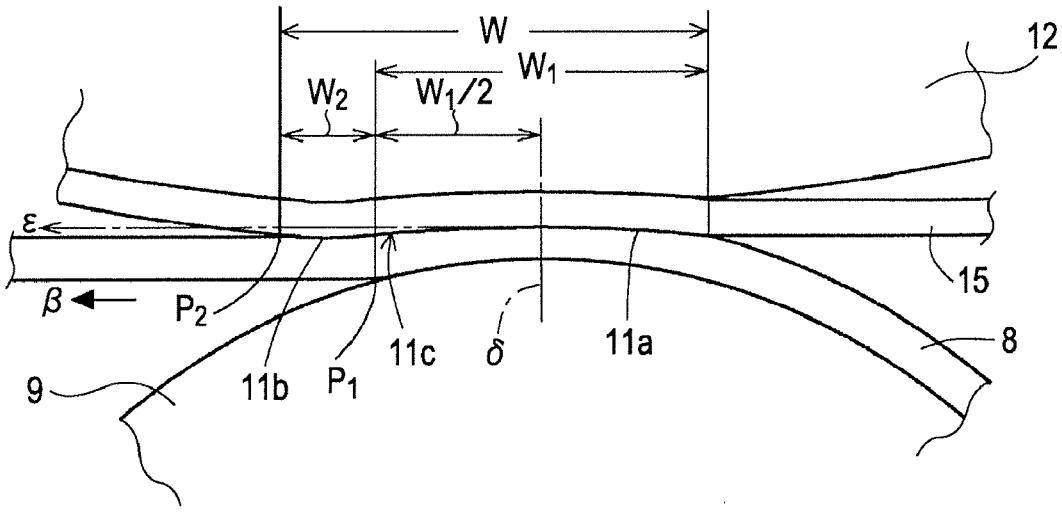
FIG. 2B is a partial enlarged view illustrating a secondary transfer nip shown in FIG. 2A.

FIG. 1 is a view schematically and partially illustrating an image forming apparatus according to a first embodiment of the invention. FIG. 2A is a partial enlarged view illustrating a secondary transfer portion according to the first embodiment. FIG. 2B is a partial enlarged view illustrating a secondary transfer nip shown in FIG. 2A.

An image forming apparatus 1 according to the first embodiment performs image formation by using a liquid developer containing toner particles and carrier liquid. As shown in FIG. 1, the image forming apparatus 1 includes photosensitive members 2Y, 2M, 2C, 2K. The photosensitive members 2Y, 2M, 2C, 2K are latent image carriers carrying each latent image of yellow (Y), magenta (M), cyan (C), and black (K). The photosensitive members 2Y, 2M, 2C, 2K are arranged horizontally or substantially horizontally in a tandem configuration. As for the photosensitive members 2Y, 2M, 2C, 2K, 2Y indicates a yellow photosensitive member, 2M indicates a magenta photosensitive member, 2C indicates a cyan photosensitive member, and 2K indicates a black photosensitive member. Further, each of other members of each color is also indicated such that Y, M, C or K denoting each color is added to a reference numeral denoting the member in the same manner as in the photosensitive members.

Each of charging portions 3Y, 3M, 3C, 3K is provided on the periphery of each of the photosensitive members 2Y 2M, 2C, 2K. Further, exposure portions 4Y, 4M, 4C, 4K, developing portions 5Y, 5M, 5C, 5K, primary transfer portions 6Y 6M, 6C, 6K and photosensitive member cleaning portions 7Y 7M, 7C, 7K are arranged in this order in the rotational direction a of the photosensitive members 2Y 2M, 2C, 2K from the charging portions 3Y, 3M, 3C, 3K, respectively. Each of the exposure portions 4Y, 4M, 4C, 4K writes a latent image onto each of the photosensitive members 2Y, 2M, 2C, 2K. Each of the developing portions 5Y, 5M, 5C, 5K develops the latent image carried by each of the photosensitive members 2Y, 2M, 2C, 2K by toner as the liquid developer so as to form a toner image as a developer image.

The image forming apparatus 1 includes an intermediate transfer belt 8, which is ring-shaped. The intermediate transfer belt 8 serves as an image carrier and as a transfer belt. The intermediate transfer belt 8 is arranged above the photosensitive members 2Y, 2M, 2C, 2K. The intermediate transfer belt 8 contacts with each of the photosensitive members 2Y, 2M, 2C, 2K with pressure at each of the primary transfer portions 6Y, 6M, 6C, 6K. Each of the primary transfer portions 6Y, 6M, 6C, 6K color-superimposes and transfers each toner image of each color carried by each of the photosensitive members 2Y, 2M, 2C, 2K onto the intermediate transfer belt 8. Therefore, a full-color toner image is carried by the intermediate transfer belt 8.

The intermediate transfer belt 8 is formed into a relatively soft elastic belt having a three-layered structure. Although not shown, the three-layered structure has a flexible base layer such as a resin, an elastic layer such as a rubber layer which is formed on a surface of the base layer, and a surface layer which is formed on a surface of the elastic layer. In this case, the base layer is located at an inner circumferential side and the surface layer is located on an outer circumferential side. As an example of the intermediate transfer belt 8, a resin such as a polyimide resin can be used as the base layer, and a rubber layer such as an urethane rubber can be used as the elastic layer. Further, for example, a fluororesin, a fluoro-rubber based material, or the like can be used as the surface layer. However, the intermediate transfer belt 8 is not limited thereto. The intermediate transfer belt 8 is stretched between the intermediate transfer belt driving roller 9 and the intermediate transfer belt tension roller 10. The driving force of an intermediate transfer belt driving motor (not shown) is transmitted to the intermediate transfer belt driving roller 9 and the intermediate transfer belt tension roller 10. Then, the intermediate transfer belt 8 is configured to rotationally move in the rotational movement direction β in a state where tension is applied to the intermediate transfer belt 8.

Arrangement orders of members such as the photosensitive members corresponding to each color of Y, M, C and K is not limited to the example as shown in FIG. 1, and can be arbitrarily set.

A secondary transfer portion 11, which is a transfer apparatus, is provided on the side of the intermediate transfer belt driving roller 9 with respect to the intermediate transfer belt 8. The secondary transfer portion 11 includes a secondary transfer roller 12, a tension roller 13 and a secondary transfer roller cleaning portion 14.

As shown in FIG. 1 and FIG. 2A, the secondary transfer roller 12 includes a base material 12*a* and an elastic layer (for example, a rubber layer or the like) 12*b* made of an elastic member. The elastic layer 12*b* is arranged on an outer circumferential surface of the base material 12*a*. The elastic layer 12*b* forms an electric resistance layer. As the base material 12*a*, an iron metal material can be used, for example. Further, as the elastic layer 12*b*, an elastic material such as an urethane rubber can be used as an elastic layer of the above-mentioned intermediate transfer belt 8. In this case, the thickness of the elastic layer 12*b* of the secondary transfer roller 12 is larger than that of the elastic layer of the intermediate transfer belt 8.

A radius $R_1$ (mm) of the outer circumferential surface of the elastic layer 12*b* of the secondary transfer roller 12 is set to be larger than a radius $R_2$ (mm) of the intermediate transfer belt driving roller 9 ($R_1>R_2$). Further, in the image forming apparatus 1 according to the first embodiment, although not shown, the thickness (μm) of the elastic layer of the intermediate transfer belt 8 is set to be smaller than the radius $R_2$ (mm) of the intermediate transfer belt driving roller 9. The secondary transfer roller 12 rotates in the rotational direction γ at the time of the image formation.

In the secondary transfer roller 12, the elastic layer 12*b* contacts with the intermediate transfer belt driving roller 9 with pressure through the intermediate transfer belt 8 by a biasing force of a biasing unit such as a spring (not shown). Therefore, as shown in FIGS. 2A and 2B, a pressure-contact nip 11*a* is formed between the intermediate transfer belt 8 and the elastic layer 12*b* of the secondary transfer roller 12. At this time, the intermediate transfer belt driving roller 9 functions as a backup roller with respect to the pressing force of the secondary transfer roller 12. In this case, since the thickness of the elastic layer 12*b* of the secondary transfer roller 12 is larger than that of the elastic layer of the intermediate transfer belt 8, the elastic layer 12*b* is concaved in a circular arc form. At this time, the elastic layer 12*b* is concaved such that the intermediate transfer belt 8 and the intermediate transfer belt driving roller 9 enters into the elastic layer 12*b* of the secondary transfer roller 12. That is to say, the pressure-contact nip 11*a* has a shape curving and projecting to the side of the elastic layer 12*b* of the secondary transfer roller 12 in a circular arc form.

The tension roller 13 is arranged at a position which is after the intermediate transfer belt roller 9 and before the intermediate transfer belt tension roller 10 in the movement direction β of the intermediate transfer belt 8. The intermediate transfer belt 8 which has passed through the pressure-contact nip 11*a* is guided to the side of the secondary transfer roller 12 by being wound over the tension roller 13. Further, the intermediate transfer belt 8 which has passed through the pressure-contact nip 11*a* makes contact with (that is, is wound over) the elastic layer 12*b* of the secondary transfer roller 12. Therefore, the contact nip 11*b* is formed between the intermediate transfer belt 8 and the elastic layer 12*b* of the secondary transfer roller 12. The contact nip 11*b* is formed so as to follow a termination end of the pressure-contact nip 11*a* (an end of the pressure-contact nip 11*a* on the advanced side in the intermediate transfer belt movement direction β). That is to say, the contact nip 11*b* is formed as a contact nip by the contact of the intermediate transfer belt 8 and the secondary transfer roller 12 in a region where the intermediate transfer belt 8 and the secondary transfer roller 12 are not in contact with the intermediate transfer belt driving roller 9. The pressure-contact nip 11*a* and the contact nip 11*b* constitute a secondary transfer nip 11*c* which corresponds a transfer nip portion. With the transfer nip portion, a toner image carried by the intermediate transfer belt 8 is secondarily transferred onto a transfer material 15 such as transfer paper.

At the secondary transfer nip 11*c*, the transfer material 15 passing through the pressure-contact nip 11*a* is pinched together with the intermediate transfer belt 8 between the intermediate transfer belt driving roller 9 and the elastic layer 12*b* of the secondary transfer roller 12. Further, the transfer material 15 passing through the contact nip 11*b* is pinched between the intermediate transfer belt 8 separated from the intermediate transfer belt driving roller 9 and the elastic layer 12*b* of the secondary transfer roller 12. The transfer material 15 which has passed through the contact nip 11*b* is separated from the intermediate transfer belt 8 and moves in a state of being wound over the elastic layer 12*b* of the secondary transfer roller 12. Finally, the transfer material 15 is separated from the elastic layer 12*b*.

Accordingly, a position $p_1$ is different from a position $p_2$ with respect to a tangential direction ϵ at an intersection of a virtual line δ and an outer circumferential surface of the intermediate transfer belt 8. The virtual line δ is a line connecting the center 9*a* of the intermediate transfer belt driving roller 9 and the center 12*c* of the secondary transfer roller 12. Further, the tangential direction ϵ is a direction orthogonal to the virtual line δ. In this case, the intermediate transfer belt 8 is separated from the intermediate transfer belt driving roller 9 at the position $p_1$. The transfer material 15 is separated from the intermediate transfer belt 8 at the position $p_2$. To be more specific about the relationship between the position $p_1$ and the position $p_2$, the position $p_1$ is located on the previous side in the movement direction β of the intermediate transfer belt 8 with respect to the position $p_2$.

As shown in FIG. 2B, in the secondary transfer nip 11*c*, a length of the pressure-contact nip 11*a* (that is, a pressure-contact nip width) on the circumferential surface of the intermediate transfer belt 8 in the movement direction β is denoted by $W_1$ (mm). Further, in the secondary transfer nip 11*c*, a length of the contact nip 11*b* (that is, a contact nip width) on the circumferential surface of the intermediate transfer belt 8 in the movement direction β is denoted by $W_2$ (mm). That means that a length of the secondary transfer nip 11*c* on the intermediate transfer belt 8 in the movement direction β (that is, secondary transfer nip width) W (mm) includes the length $W_1$ (mm) of the pressure-contact nip 11*a* and the length $W_2$ (mm) of the contact nip 11*b*. Note that although the secondary transfer nip width W (mm), the pressure-contact nip width $W_1$ (mm) and the contact nip width $W_2$ (mm) are shown as widths in the tangential direction ϵ in FIG. 2B for convenience of description, these nip widths are widths in the movement direction β of the intermediate transfer belt 8.

In the image forming apparatus 1 according to the first embodiment, the contact nip width $W_2$ (mm) is set to be smaller than half the pressure-contact nip width $W_1$ (mm) (that is, $W_2<W_1/2$). In other words, a length of the contact nip 11*b* on the circumferential surface of the secondary transfer roller 12 in the rotational direction γ of the secondary transfer roller 12 is smaller than half a length of the pressure-contact nip 11*a* on the circumferential surface of the secondary transfer roller 12 in the rotational direction γ of the secondary transfer roller 12. Further, the contact nip width $W_2$ is set to be larger than the thickness of the elastic layer of the intermediate transfer belt 8.

Figure 3B:
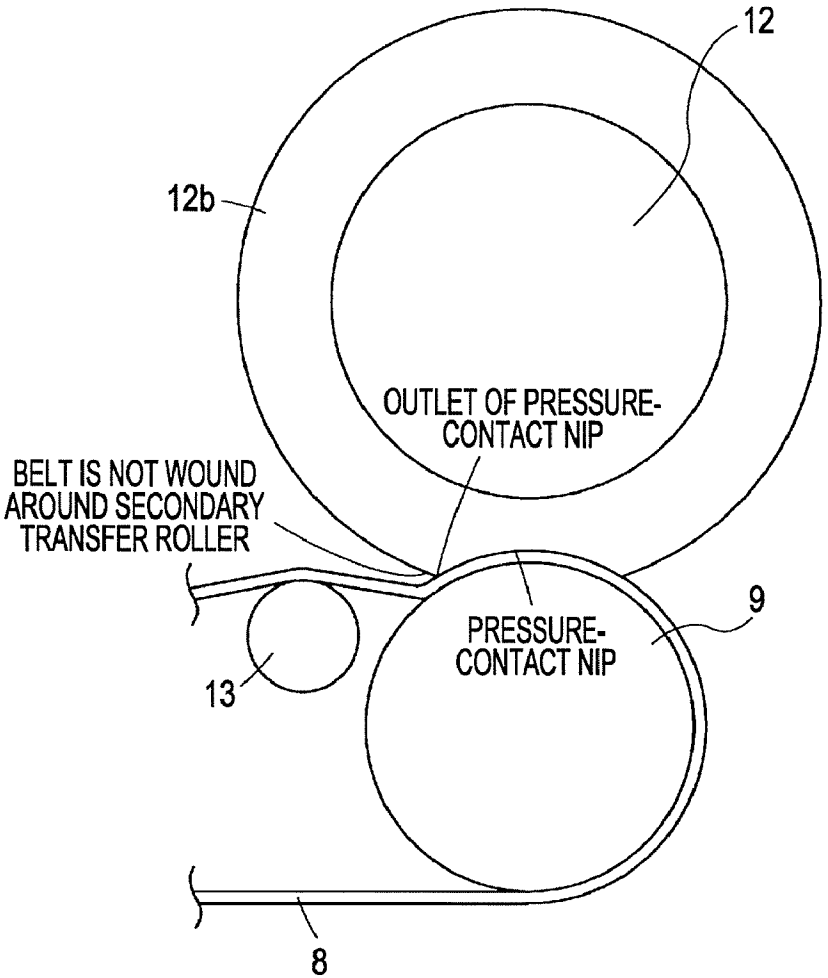
FIGS. 3A and 3B are views illustrating a measuring method of the secondary transfer nip.
Figure 3A:
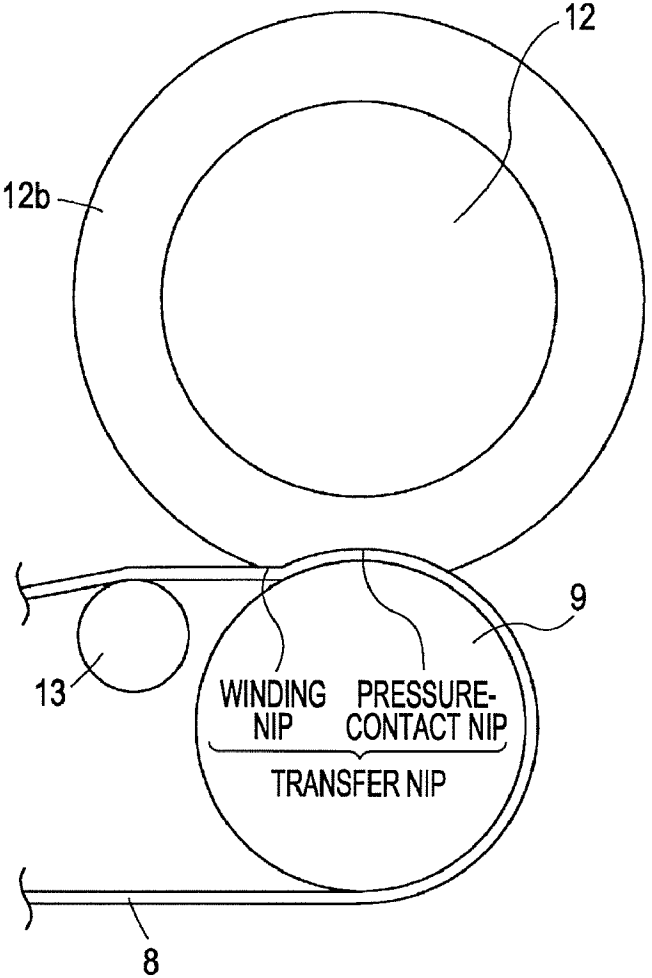

A method of measuring the secondary transfer nip width W (mm), the pressure-contact nip width $W_1$ (mm) and the contact nip width $W_2$ (mm) in the secondary transfer nip 11*c* will be described. As shown in FIG. 3A, the intermediate transfer belt 8 is wound over the intermediate transfer belt driving roller 9 and the tension roller 13, at first. Then, a belt tension application mechanism (not shown) applies to the intermediate transfer belt 8 a tension same as that applied in normal use state. Subsequently, two-part curable silicone rubber for taking a forming pattern is coated on a portion where a measuring nip of the secondary transfer roller 12 is to be formed. As the two-part curable silicone rubber, Exafine (injection type) manufactured by GC Corporation can be used in the embodiment. Then, the two-part curable silicone rubber of the secondary transfer roller 12 is pressed against the belt driving roller 9 through the intermediate transfer belt 8 with a pressure-contact force applied in normal use state to form a deformation portion on the two-part curable silicone rubber. After the two-part curable silicone rubber is cured, the width of the nip formation portion is measured with a slide caliper. The width of the nip formation portion is measured in a state where the nip formation portion which is a thin-filmed portion on the deformation portion is made flat on a flat surface. The measured width of the nip formation portion is the secondary transfer nip width W (mm) including the pressure-contact nip width $W_1$ (mm) and the contact nip width $W_2$ (mm). Subsequently, as shown in FIG. 3B, the tension applied to the intermediate transfer belt 8 is sufficiently relaxed and the intermediate transfer belt 8 is wound over the intermediate transfer belt driving roller 9 to a degree more than that in the above-described state where the tension is applied thereto. Then, in the same manner as described above, the two-part curable silicone rubber is coated on the secondary transfer roller 12. At the same time, the secondary transfer roller 12 contacts with the intermediate transfer belt driving roller 9 with pressure (a pressure-contact force) applied in normal use state so as to from a deformation portion (corresponding to the pressure-contact nip portion) on the two-part curable silicone rubber. At this time, the intermediate transfer belt 8 is wound over the side of the intermediate transfer belt driving roller 9 from an outlet of the pressure-contact nip (a termination end of the pressure-contact nip in the movement direction of the transfer material) but not wound over the side of the secondary transfer roller 12. Therefore, a contact nip is not formed. After the two-part curable silicone rubber is cured, the width of the nip formation portion is measured by using a slide caliper. The width of the nip formation portion is measured in a state where the nip formation portion which is a thin-filmed portion on the deformation portion is made flat on a flat surface. The measured width of the nip formation portion is the pressure-contact nip width $W_1$ (mm). Then, the contact nip $W_2$ (mm) is obtained from the measured secondary transfer nip width and the pressure-contact nip width $W_1$ ($W_2=W-W_1$).

As described above, the secondary transfer nip width includes the pressure-contact nip width $W_1$ (mm) and the contact nip width $W_2$ (mm). Therefore, the secondary transfer nip width is formed as a long transfer nip which is longer than a transfer nip including only the pressure-contact nip width $W_1$ (mm). However, since the contact nip width $W_2$ (mm) is restricted to be smaller than the pressure-contact nip width $W_1$ (mm), the contact nip width $W_2$ (mm) is extremely small in comparison with the contact nip width in the image forming apparatus described in Japanese Patent Application Publication No. 2001-166611 in which the contact nip width is formed to be larger than the pressure-contact nip width.

Further, as shown in FIG. 1, the image forming apparatus 1 has gate rollers 16 which feed the transfer material 15 toward the secondary transfer nip 11*c*. The gate rollers 16 feed the transfer material 15 to the direction ζ of the secondary transfer nip 11*c*. Then, during the image formation, the secondary transfer roller 12 rotates in the rotational direction γ when the intermediate transfer belt 8 moves in the movement direction β while a transfer bias is applied to the secondary transfer roller 12. With this, at the secondary transfer nip 11*c*, a toner image having been transferred onto the intermediate transfer belt 8 is transferred onto the transfer material 15 fed from the gate rollers 16.

Transfer mechanism in the secondary transfer portion 11 having such a configuration is assumed, as follows. The elastic layer of the intermediate transfer belt 8 is deformed by the pressure load at the pressure-contact nip 11*a*. Therefore, the surface of the intermediate transfer belt 8 follows irregularities on the surface of the transfer material 15. Therefore, adhesion between the toner image carried by the intermediate transfer belt 8 and the transfer material 15 is increased. In a state where adhesion between the toner image and the transfer material 15 is increased, an electric field is formed by the secondary transfer bias on the pressure-contact nip 11*a*. Therefore, the toner image carried by the intermediate transfer belt 8 is effectively transferred onto a surface of the transfer material 15 having irregularities.

When the toner image carried by the intermediate transfer belt 8 is transferred onto the surface of the transfer material 15 by the secondary transfer nip 11*c* including only the pressure-contact nip 11*a*, toner adhered to a convex portion on the surface of the transfer material 15 is relatively easily separated from the intermediate transfer belt 8. However, toner adhered to the concave portion on the surface of the transfer material 15 is not easily separated from the intermediate transfer belt 8 in comparison with the toner adhered to the convex portion of the transfer material 15. The reason of this is considered to be as follows. When the contact nip 11*b* is not formed, the transfer material 15 is separated from the intermediate transfer belt 8 at an outlet of the pressure-contact nip 11*a* (at a termination end of the pressure-contact nip 11*a* in the movement direction of the transfer material 15). At this time, a relatively large physical adhesion acts between the intermediate transfer belt 8 and the toner and between the transfer material and the toner by the pressure applied on the pressure-contact nip 11*a*. The pressure is drastically released near the outlet of the pressure-contact nip 11*a* so that the deformation of the elastic layer of the intermediate transfer belt 8 is recovered. Then, since a slight space is likely to be generated between the concave portion of the transfer material 15 and the intermediate transfer belt 8 at the concave portion of the transfer material 15, aggregation force by the toner positioned on the concave portion of the transfer material 15 becomes smaller. On the other hand, since a large physical adhesion between the intermediate transfer belt 8 and the toner is present near the outlet of the pressure-contact nip 11*a*, the aggregation force by the toner is smaller than the physical adhesion between the intermediate transfer belt 8 and the toner. Therefore, a toner film is divided in the film. As a result, a part of the toner located on the concave portion of the transfer material 15 is adhered to the transfer material 15. However, the remaining toner is kept being adhered to the intermediate transfer belt 8 so that the toner remained not to be transferred is considered to be present.

In the secondary transfer portion 11 according to the first embodiment, the contact nip 11*b* is formed so as to follow the pressure-contact nip 11*a* so that the secondary transfer nip 11*c* is formed to be a long transfer nip. In the contact nip 11*b*, a pressure contact between the intermediate transfer belt driving roller 9 and the secondary transfer roller 12 through the intermediate transfer belt 8 is released. Accordingly, when the transfer material 15 is passing through the contact nip 11*b*, a pressure is hardly applied to the toner pinched between the transfer material 15 and the intermediate transfer belt 8. Therefore, the physical adhesion between the intermediate transfer belt 8 and the toner image carried by the intermediate transfer belt 8 is relaxed. Further, a transfer current is generated by the secondary transfer bias at the pressure-contact nip 11*a*. However, the intermediate transfer belt 8 and the transfer material 15 are charged with the transfer current so as to generate an electric field at the contact nip 11*b*. Namely, when the transfer material 15 is passing through the contact nip 11*b*, the electric field acts on the toner in the state where the physical adhesion between the intermediate transfer belt 8 and the toner is relaxed. As a result, when the intermediate transfer belt 8 is separated from the transfer material 15, toner adhered to the concave portion on the surface of the transfer material 15 is easily separated from the intermediate transfer belt 8 by the effect of the electric field and the aggregation force with the toner adhered to the convex portion adjacent to the concave portion. In such a manner, the toner adhered to the concave portion of the transfer material 15 is relatively easily separated from the intermediate transfer belt 8 with the contact nip 11*b* formed so as to follow the pressure-contact nip 11*a*. This makes it possible to make transfer efficiency better.

The transfer material 15 passing through the pressure-contact nip 11*a* is pinched together with the intermediate transfer belt 8 between the intermediate transfer belt driving roller 9 and the elastic layer 12*b* of the secondary transfer roller 12 at the secondary transfer nip 11*c*.

The secondary transfer roller cleaning portion 14 removes the liquid developer adhered to the elastic layer 12*b* of the secondary transfer roller 12 with a cleaning member such as a cleaning blade. The liquid developers removed by the cleaning member are collected into a liquid developer container.

The transfer material 15 onto which the toner image is transferred at the secondary transfer portion 11 is transported to a commonly known fixing unit (not shown). Then, the toner image transferred onto the transfer material 15 is heat-pressed and fixed by the fixing unit. The transfer material 15 onto which the toner image is fixed is accommodated in a transfer material discharge tray (not shown).

According to the image forming apparatus 1 of the first embodiment, the secondary transfer nip 11*c* includes the pressure-contact nip 11*a* and the contact nip 11*b* so as to be formed as a long transfer nip which is longer than a transfer nip including only the pressure-contact nip. Accordingly, excellent transfer efficiency can be obtained in comparison with that in the transferring performed by using only the pressure-contact nip 11*a*.

The contact nip width $W_2$ (mm) when the intermediate transfer belt 8 is wound over the secondary transfer roller 12 is made smaller than half the pressure-contact nip width $W_1$ (mm). This decreases the winding amount of the intermediate transfer belt 8 wound over the secondary transfer roller 12. Therefore, the intermediate transfer belt 8 hardly bends in the compression direction along the outer circumferential surface of the secondary transfer roller 12. Accordingly, the bending direction of the surface of the intermediate transfer belt 8 hardly changes at the secondary transfer nip 11*c* so that change in the surface speed of the intermediate transfer belt 8 between the pressure-contact nip 11*a* and the contact nip 11*b* is suppressed. As a result, deviation of the image transferred onto the transfer material 15 can be suppressed at the time of the secondary transferring.

Further, when the pressure-contact nip 11*a* has a shape projecting to the side of the secondary transfer roller 12, the radius $R_1$ (mm) of the secondary transfer roller 12 is made larger than the radius $R_2$ (mm) of the intermediate transfer belt driving roller 9 so that the tension roller 13 easily guides the intermediate transfer belt 8 from the termination end of the pressure-contact nip 11*a* to the side of the intermediate transfer belt driving roller 9. Therefore, the contact nip width $W_2$ (mm) can be made smaller, thereby effectively suppressing bending of the surface of the intermediate transfer belt 8 along the outer circumferential surface of the secondary transfer roller 12 in the compression direction.

Further, when the pressure-contact nip 11*a* has a shape projecting to the side of the secondary transfer roller 12, the thickness (mm) of the elastic layer 12*b* of the secondary transfer roller 12 is made larger than the contact nip width $W_2$ (mm) so that the tension roller 13 easily guides the intermediate transfer belt 8 from the termination end of the pressure-contact nip 11*a* to the side of the intermediate transfer belt driving roller 9 in the same manner. Therefore, the contact nip width $W_2$ (mm) can be made smaller, thereby further effectively suppressing bending of the surface of the intermediate transfer belt 8 along the outer circumferential surface of the secondary transfer roller 12 in the compression direction.

Further, when the pressure-contact nip 11*a* has a shape projecting to the side of the secondary transfer roller 12, the thickness (mm) of the elastic layer of the intermediate transfer belt 8 is made smaller than the contact nip width $W_2$ (mm) so that the tension roller 13 easily guides the intermediate transfer belt 8 from the termination end of the pressure-contact nip 11*a* to the side of the intermediate transfer belt driving roller 9 in the same manner. Therefore, the contact nip width $W_2$ (mm) can be made smaller, thereby further effectively suppressing bending of the surface of the intermediate transfer belt 8 along the outer circumferential surface of the secondary transfer roller 12 in the compression direction.

Further, when the secondary transfer nip 11*c* is formed so as to be a long transfer nip, the width of the secondary transfer nip 11*c* in the movement direction of the transfer material 15 can be made sufficiently short in comparison with the image forming apparatus described in Japanese Patent Application Publication No. 2001-166611. Both of a contact area between the intermediate transfer belt 8 and the secondary transfer roller 12 and a contact area between the intermediate transfer belt 8 and the transfer material 15 can be made smaller. Therefore, effect on the intermediate transfer belt 8 by the difference in the pressure load in the direction orthogonal to or substantially orthogonal to the movement direction of the transfer material 15, a position of the transfer material 15 at the secondary transfer nip 11*c* (a position different from a predetermined position), or a posture (skew) of the transfer material 15 can be made smaller. Accordingly, the meandering of the intermediate transfer belt 8 can be effectively suppressed.

Further, the movement direction β of the intermediate transfer belt 8 which has passed through the pressure-contact nip 11*a* can be made stable by arranging the tension roller 13 at a position advanced in the movement direction β of the intermediate transfer belt 8 with respect to the intermediate transfer belt driving roller 9. This makes it possible to suppress the wobble of the intermediate transfer belt 8 which has passed through the pressure-contact nip 11*a* in the movement direction β so as to reliably form the contact nip 11*b*. At the same time, the contact nip width $W_2$ (mm) can be more reliably made smaller than half the pressure-contact nip width $W_1$ (mm).

In addition, the movement speed of the intermediate transfer belt 8 can be made stable by driving the intermediate transfer belt 8 by the intermediate transfer belt driving roller 9 in the secondary transfer portion 11. Therefore, the movement speed of the transfer material 18 at the secondary transfer nip 11*c* can be made stable so that the image deviation of the transfer image is hardly caused.

In such a manner, according to the image forming apparatus 1 of the first embodiment, excellent transfer efficiency is obtained while suppressing the deviation of the transfer image. Moreover, the meandering of the intermediate transfer belt 8 can be effectively suppressed according to the image forming apparatus 1 of the first embodiment.

Other configurations and other operation effects in the image forming apparatus 1 according to the first embodiment are the same as those with an existing tandem type image forming apparatus using a liquid developer.

Figure 4:
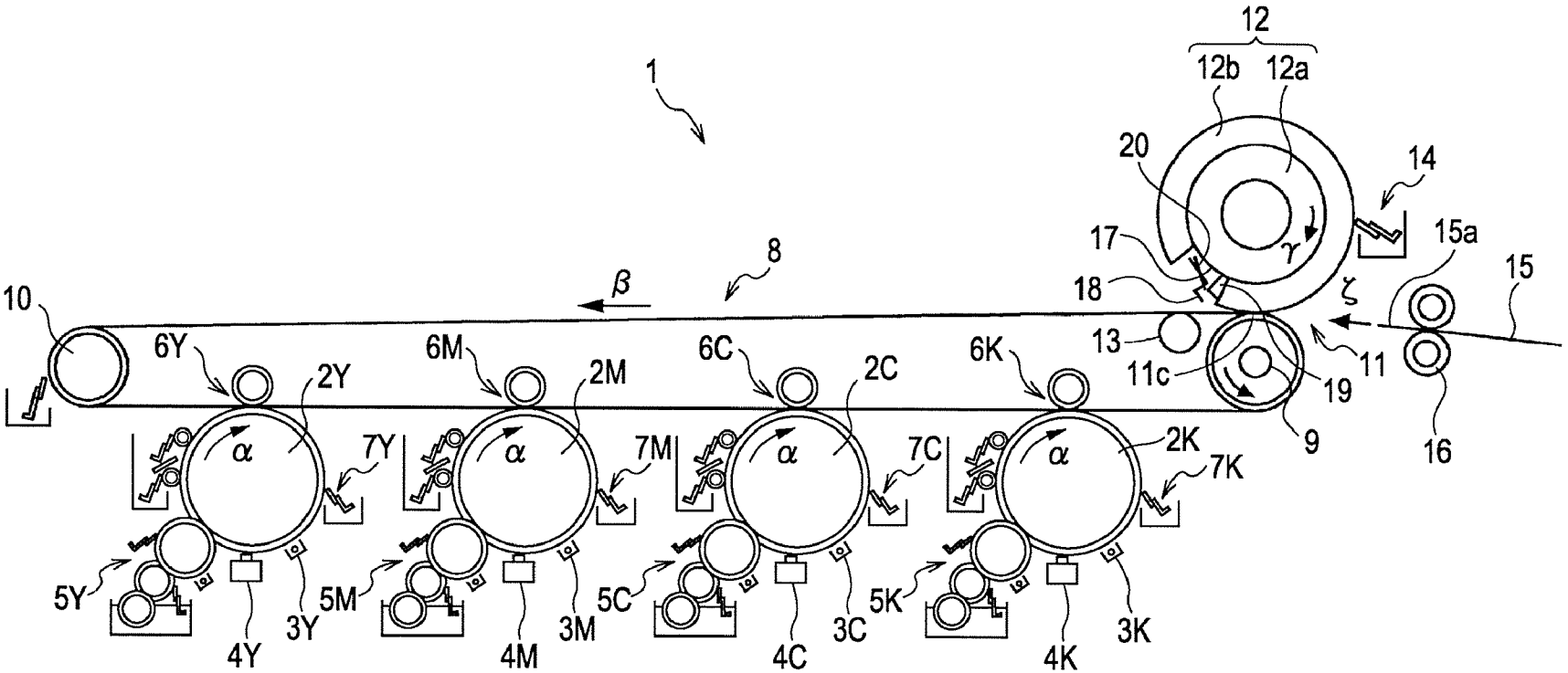
FIG. 4 is a view illustrating an image forming apparatus according to a second embodiment of the invention in the same manner as in FIG. 1.
Figure 5:
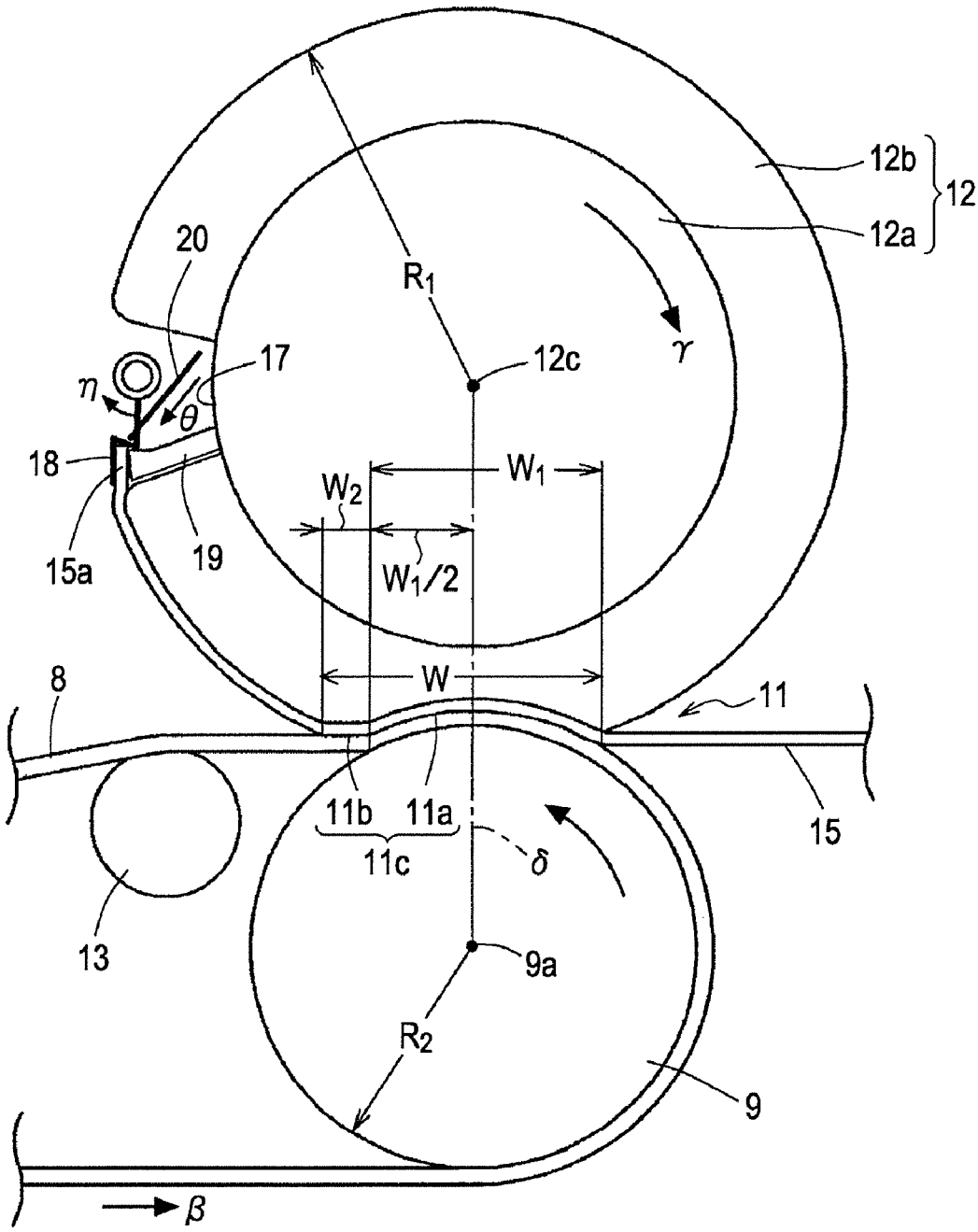
FIG. 5 is a partial enlarged view illustrating a secondary transfer portion according to the second embodiment in the same manner as in FIG. 2A.

FIG. 4 is a view illustrating an image forming apparatus according to a second embodiment of the invention in the same manner as in FIG. 1. FIG. 5 is a partial enlarged view illustrating a secondary transfer portion in the same manner as in FIG. 2A.

As shown in FIG. 4 and FIG. 5, the image forming apparatus 1 according to the second embodiment is different from that according to the first embodiment in that the elastic layer 12*b* is not provided on the entire circumference of the base material 12*a*. The image forming apparatus 1 according to the second embodiment has a concave portion 17 arranged between both ends of the elastic layer 12*b* in the circumferential direction of the secondary transfer roller. In this case, the length of the elastic layer 12*b* in the circumferential direction of the secondary transfer roller is set to be longer than the length of the transfer material 15 of which the size in the transfer material movement direction is the maximum among the transfer materials 15 used in the image forming apparatus 1.

A gripper 18, a gripper supporting member 19 and a separation claw 20 are arranged in the concave portion 17. The gripper 18 corresponds to a transfer material gripping unit, the gripper supporting member 19 corresponds to a transfer material gripping unit reception member on which the gripper 18 is seated, and the separation claw 20 corresponds to a transfer material separation member. Although not shown, a plurality of grippers 18 are arranged along an axial direction of the secondary transfer roller 12. The number of the grippers 18 is predetermined. Each gripper 18 is formed in a comb-tooth pattern. The gripper supporting members 19 are arranged so as to correspond to each gripper 18. Further, the separation claws 20 are arranged between the teeth of a comb of the grippers 18 and on both outer sides of the teeth of the comb.

Each gripper 18 is provided integrally with the gripper supporting member 19 so as to be rotationally movable in the rotation direction η between a gripping position as shown in FIG. 5 and a releasing position as shown in FIG. 4. The top edge 15*a* of the transfer material 15 is pinched between the gripper 18 and the gripper supporting member 19 at the gripping position, and is released at the releasing position. Each separation claw 20 is provided so as to be movable between a stowed position as shown in FIG. 5 and a projecting position (not shown). The claw 20 linearly moves from the stowed position in the direction θ. A top end of the separation claw 20 is located in the concave portion 17 at the stowed position, and projects to the outside of the concave portion 17 to separate a rear surface of the transfer material 15, onto which the toner image has been transferred, from the outer circumferential surface of the secondary transfer roller 12 at the projecting position. Note that the rear surface of the transfer material 15 is a surface opposite to the surface onto which a toner mage is transferred.

Immediately before the concave portion 17 reaches the secondary transfer nip 11*c*, the grippers 18 rotationally move toward the gripper supporting members 19 and grip the top edge 15*a* of the transfer material 15 fed from the gate rollers 16 in the feeding direction ζ between the grippers 18 and the gripper supporting members 19. The toner image carried by the intermediate transfer belt 8 is transferred onto the transfer material 15 at the secondary transfer nip 11*c* in a state where the grippers 18 grip the top edge 15*a* of the transfer material 15. Further, the transfer material 15 which has passed through the secondary transfer nip 11*c* is reliably separated from the intermediate transfer belt 8 because the top edge 15*a* of the transfer material 15 is gripped by the grippers 18. Thereafter, the grippers 18 rotationally move in the direction of leaving the gripper supporting members 19 so as to release the top edge 15*a* of the transfer material 15. Further, each separation claw 20 is projected to the projection position soon after the griping of the transfer material by the grippers 18 is released. Then, the rear face of the transfer material 15 is projected from each separation claw 20. Thus, the transfer material 15 is separated from the secondary transfer roller 12. Then, each separation claw 20 returns to the retreat position in the concave portion 17. Each operation of the grippers 18 and the separation claws 20 is controlled by a gripper control cam (not shown) and a separation claw control cam (not shown), respectively, by rotating the secondary transfer roller 12.

According to the image forming apparatus 1 of the second embodiment, the toner image carried by the intermediate transfer belt 8 is transferred onto the transfer material 15 in a state where the top edge 15*a* of the transfer material 15 is gripped by the grippers 18. Therefore, the transfer material 15 can be reliably separated from the intermediate transfer belt 8 after the transferring. Further, since the rear face of the transfer material 15 is projected from the outer circumferential surface by the separation claws 20, the transfer material 15 can be reliably separated from the outer circumferential surface of the elastic layer 12*b* of the secondary transfer roller 12 after the transferring.

Other configurations and other operation effects in the image forming apparatus 1 according to the second embodiment are the same as those in the image forming apparatus 1 according to the first embodiment.

Figure 6A:
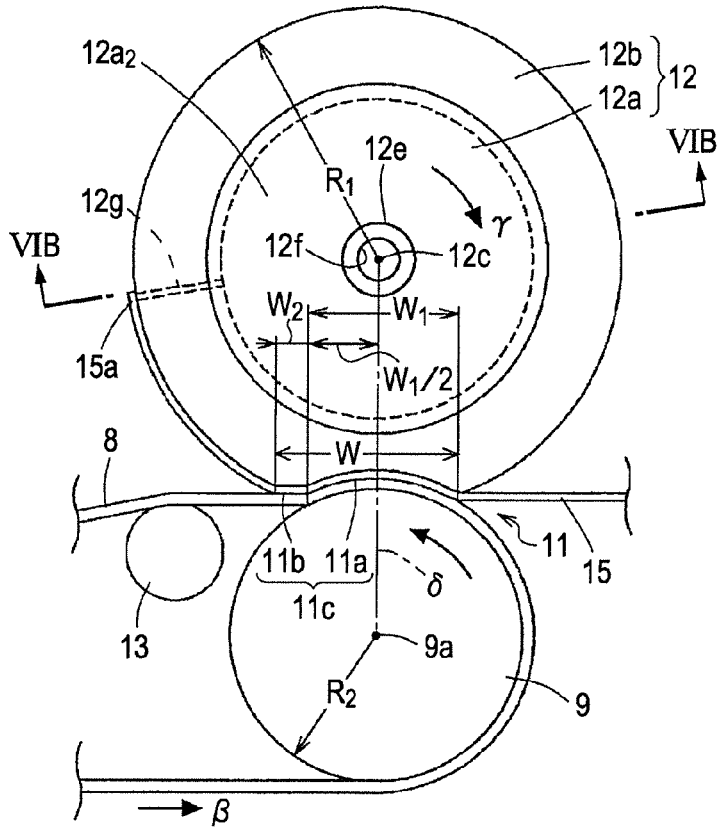
FIGS. 6A and 6B are views illustrating an image forming apparatus according to a third embodiment of the invention.
Figure 6B:
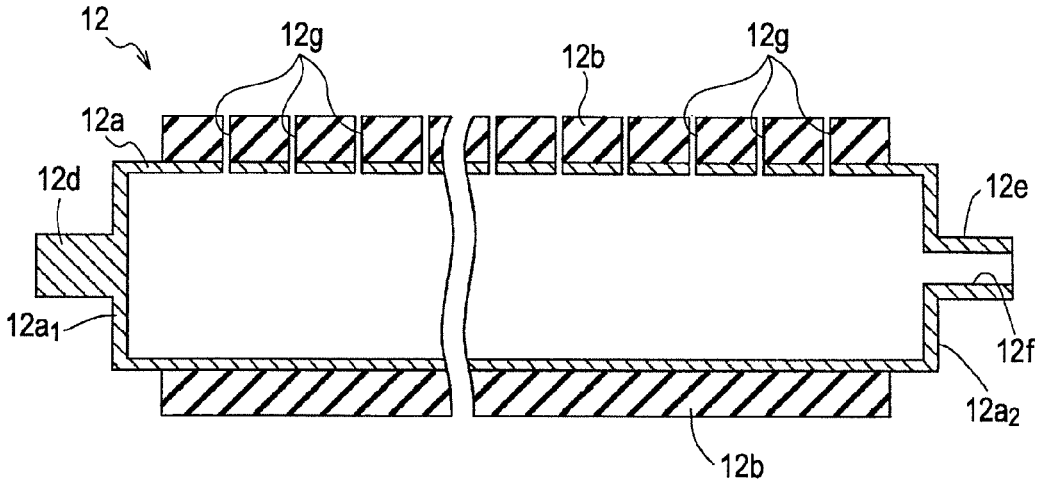

FIGS. 6A and 6B are views illustrating an image forming apparatus according to a third embodiment of the invention. FIG. 6A is a partial enlarged view illustrating a secondary transfer portion in the same manner as in FIG. 2A. FIG. 6B is a cross-sectional view illustrating a cross section cut along a line VIB-VIB in FIG. 6A.

As shown in FIGS. 6A and 6B, in the image forming apparatus 1 according to the third embodiment, the base material 12*a* of the secondary transfer roller 12 is formed into a cylindrical shape. An end of the cylindrical base material 12*a* is closed by a discoid end wall $12a_1$ having a rotational axis 12*d*. The other end of the base material 12*a* is partially closed by an annular end wall $12a_2$ having a rotational axis 12*e*. The rotational axis 12*e* at the other end side is formed into a cylindrical shape. Further, an air suction unit connection hole 12*f* in the axial direction which penetrates through the end wall $12a_2$ and the rotational axis 12*e* is arranged on the other end side of the base material 12*a*. Although not shown, the suction unit connection hole 12*f* is selectively connected to an air feeding unit such as an air pump and an air blower and an air suction unit through a switching valve.

Further, a plurality of air flow nozzle holes 12*g* which penetrate through a cylindrical portion of the base material 12*a* and the elastic layer 12*b* are arranged on the secondary transfer roller 12. The number of the air flow nozzle holes is predetermined. These air flow nozzle holes 12*g* are arranged along the axial direction of the secondary transfer roller 12. In this case, the air flow nozzle holes 12*g* are arranged along the axial direction of the secondary transfer roller 12 in a single row as shown in FIG. 6B. Note that the air flow nozzle holes 12*g* are not limited thereto and the air flow nozzle holes 12*g* may be arranged along the axial direction in a plurality of rows in a circumferential direction. If the air flow nozzle holes 12*g* are arranged in a plurality of rows in a circumferential direction in such a manner, the air flow nozzle holes 12*g* can be arranged in a hound's tooth pattern.

In the image forming apparatus 1 according to the third embodiment having such a configuration, the switching valve is set such that the air suction unit is connected to the air suction unit connection hole 12*f* and then the air suction unit is operated immediately before each air flow nozzle hole 12*g* reaches the secondary transfer nip 11*c*. Thus, the air in the base material 12*a* is sucked through the air suction unit connection hole 12*f* so that the air pressure in the base material 12*a* becomes a negative pressure. Then, the air near outside in the portion where the air flow nozzle holes 12*g* of the secondary transfer roller 12 are formed is sucked through each air flow nozzle hole 12*g* to inside the base material 12*a*. In this state, if the transfer material 15 is fed from the gate rollers 16 and the top edge 15*a* of the transfer material 15 reaches a portion where the air flow nozzle holes 12*g* of the secondary transfer roller 12 are formed, the top edge 15*a* of the transfer material 15 is sucked by the air flow nozzle holes 12*g* and adsorbed to the elastic layer 12*b* of the secondary transfer roller 12.

Then, the toner image carried by the intermediate transfer belt 8 is transferred onto the transfer material 15 at the secondary transfer nip 11*c* in a state where the top edge 15*a* of the transfer material 15 is adsorbed by the air flow nozzle holes 12*g*. Further, the transfer material 15 which has passed through the secondary transfer nip 11*c* is reliably separated from the intermediate transfer belt 8 because the top edge 15*a* of the transfer material 15 is adsorbed by the air flow nozzle holes 12*g*. Thereafter, the operation of the air suction unit is stopped to terminate the suction of the top edge 15*a* of the transfer material 15. Then, if the top edge 15*a* of the transfer material 15 reaches a separation position where the transfer material 15 is separated from the secondary transfer roller 12, the air feeding unit is operated and the switching valve is switched. Therefore, the air feeding unit is connected to the air suction unit connection hole 12*f*. Then, the air having a positive pressure is fed to the inside of the base material 12*a* and air having a positive pressure is flown out to the outside of the base material 12*a* through the air nozzle holes 12*g*. The transfer material 15 is easily separated from the secondary transfer roller 12 by the air flown out through the air nozzle holes.

According to the image forming apparatus 1 of the third embodiment, the toner image carried by the intermediate transfer belt 8 is transferred onto the transfer material 15 in a state where the top edge 15*a* of the transfer material 15 is sucked by the air flow nozzle holes 12*g*. Therefore, the transfer material 15 can be reliably separated from the intermediate transfer belt 8 after the transferring. Further, since the suction of the transfer material 15 by the air flow nozzle holes 12*g* is terminated after the transferring, the transfer material 15 can be easily separated from the outer circumferential surface of the elastic layer 12*b* of the secondary transfer roller 12.

Other configurations and other operation effects in the image forming apparatus 1 according to the third embodiment are the same as those in the image forming apparatus 1 according to the first embodiment.

Figure 7:
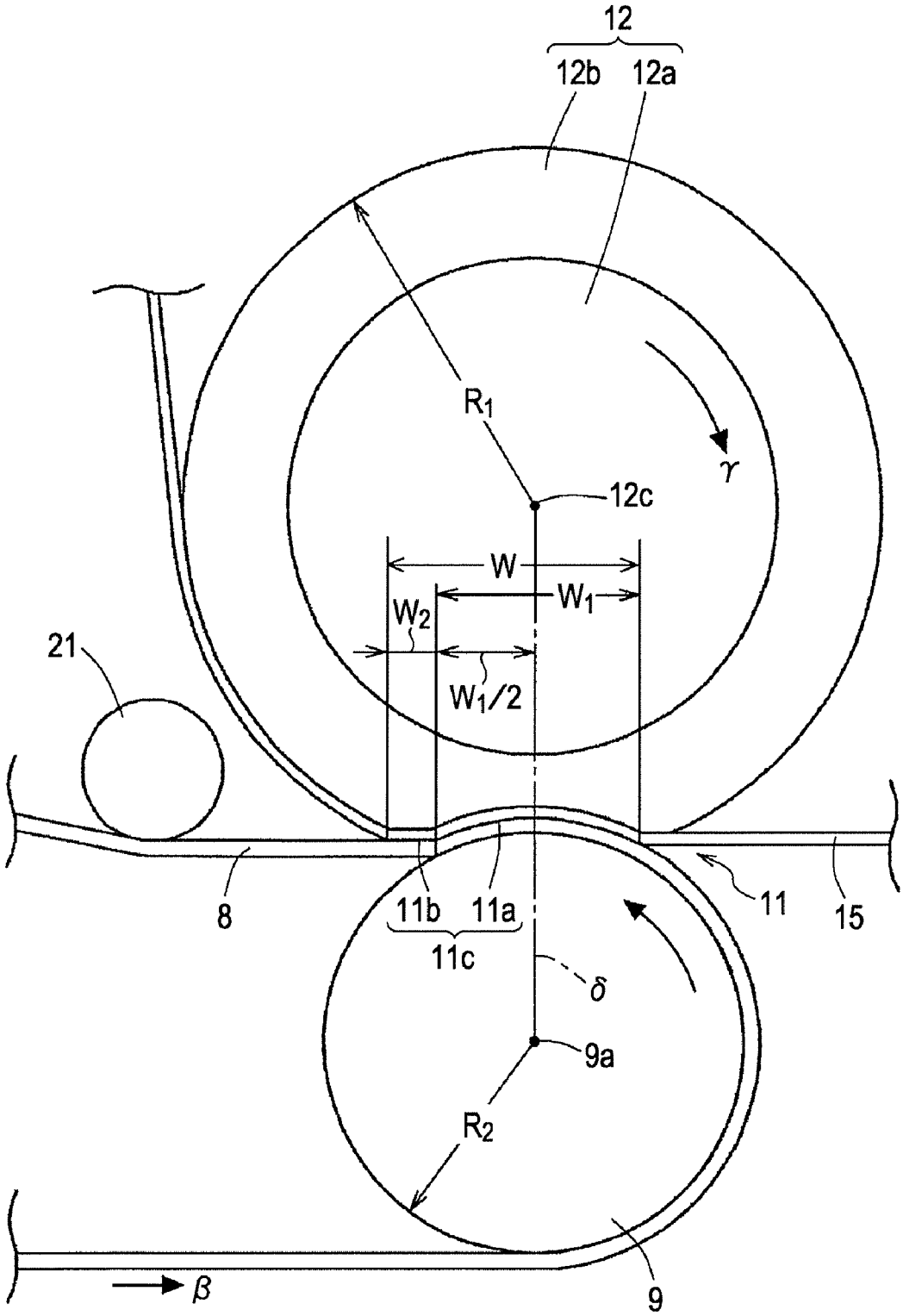
FIG. 7 is a partial enlarged view illustrating a secondary transfer portion of an image forming apparatus according to a fourth embodiment of the invention in the same manner as in FIG. 2A.

FIG. 7 is a partial enlarged view illustrating a secondary transfer portion of an image forming apparatus according to a fourth embodiment of the invention in the same manner as in FIG. 2A.

As shown in FIG. 7, in the image forming apparatus 1 according to the fourth embodiment, a contact adjustment roller (winding adjustment roller) 21 is arranged between the tension roller 13 (not shown in FIG. 7) and the secondary transfer nip 11*c*. The contact adjustment roller 21 is arranged on the outside of the intermediate transfer belt 8. Then, the contact adjustment roller 21 presses the outer circumferential surface of the intermediate transfer belt 8 against the side of the intermediate transfer belt driving roller 9 so as to adjust the size of the contact nip width $W_2$ (mm).

Other configurations and other operation effects in the image forming apparatus 1 according to the fourth embodiment are the same as those in the image forming apparatus 1 according to the first embodiment.

Next, Examples 1 to 4 according to the invention will be described.

Common Matters to Examples 1 to 4

Configuration of Image Forming Apparatus 1

A tandem type image forming apparatus as shown in FIG. 1 was manufactured and used for experiments.

Configuration of Intermediate Transfer Belt 8

The intermediate transfer belt 8 has a three-layered structure having a base layer, an elastic layer arranged on a surface of the base layer (an outer circumferential side surface), and a surface layer arranged on a surface of the elastic layer (an outer circumferential side surface). The base layer is formed with a polyimide resin having thickness of 100 μm. Further, the elastic layer is formed with a rubber layer made of urethane rubber and the thickness of the rubber layer differs depending on Examples. The details thereof will be described later. Further, the surface layer is formed with a coating layer made of a fluororesin having thickness of 7 μm. A volume resistivity of all layers of the intermediate transfer belt 8 is $9.2\times10^9$ (Ω·cm) when the voltage of 100 V is applied thereto.

Configuration of Secondary Transfer Roller 12

The elastic layer 12*b* which is a rubber layer is arranged on an outer circumferential surface of the base material 12*a* made of iron in the secondary transfer roller 12. The elastic layer 12*b* is formed with a rubber layer made of urethane rubber and the thickness of the rubber layer differs depending on Examples. The details thereof will be described later. The width of the elastic layer 12*b* (the length of the elastic layer 12*b* in the axial direction of the secondary transfer roller 12) is 330 mm. Then, the intermediate transfer belt driving roller 9 (backup roller) is pressed through the intermediate transfer belt 8 by a pressing mechanism (not shown) of the secondary transfer roller 12.

Configuration of Tension Roller 13

A commonly known tension roller is used as the tension roller 13. In this case, the tension roller 13 is provided such that a position thereof can be adjusted in order to adjust the contact nip width $W_2$ (mm).

Transfer Material

Two types of paper are used as the transfer material: coated paper (ULTRA SATIN KINFUJI 127.9 g manufactured by Oji Paper Co., Ltd.), and uncoated paper (J-paper manufactured by Fuji Xerox Co., Ltd.). Two types of transfer materials are used because difference in surface roughness between these transfer materials makes the transfer behavior different. A reason for the different transfer behaviors is considered hereinafter. Namely, in the transfer mechanism, aggregation force between toner particles, adhesion of toner particles to the transfer material and adhesion of toner particles to the intermediate transfer belt 8 are assumed to affect the transfer behavior. Further, separation behavior of the toner film from the intermediate transfer belt in the transfer nip and division behavior in the toner film are different depending on the types of transfer materials based on the surface roughness of the transfer materials. Therefore, the transfer behavior can differ depending on the types of transfer materials.

Method of Measuring Transfer Efficiency

Figure 8A:
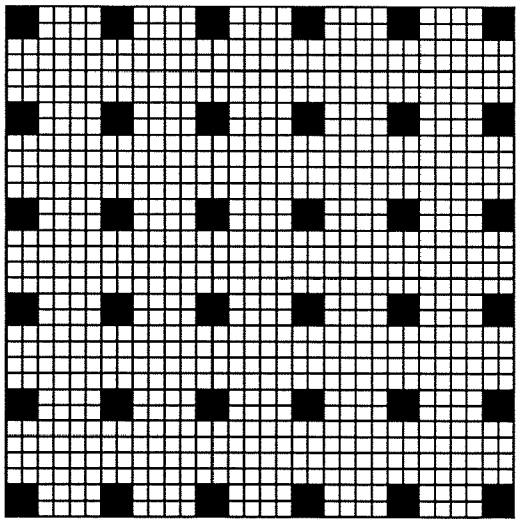
FIGS. 8A to 8C illustrate image patterns used for measuring transfer efficiency in Examples.
Figure 8B:
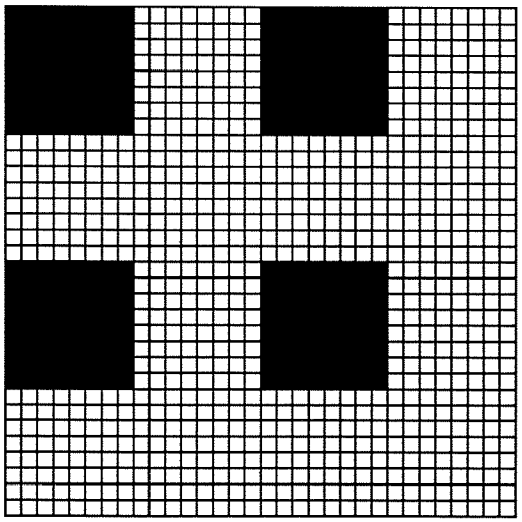
Figure 8C:
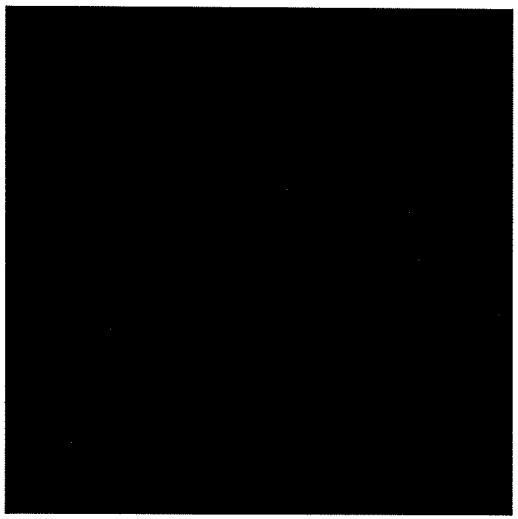

The transfer efficiency is measured for three image patterns: a 2×2 dot image as shown in FIG. 8A, an 8×8 dot image as shown in FIG. 8B and a solid image as shown in FIG. 8C. In this case, one dot is a constituent of 1200 DPI≈21 μm×21 μm. The transfer behavior is different depending on the dot size. Therefore, the transfer efficiency was evaluated by using three image patterns in such a manner. It is considered that the transfer behavior is different depending on the dot size because the separation behavior of the toner film from the intermediate transfer belt in the transfer nip and the division behavior in the toner film differ depending on the types of transfer materials based on the dot size as described above.

As for the transfer efficiency, transfer efficiency is defined to be $((OD_1-OD_2)/OD_1)\times100(\%)$ on the assumption that a concentration of toner (OD value) carried by intermediate transfer belt 8 before the secondary transferring is $OD_1$ and the concentration of toner (OD value) remaining on the intermediate transfer belt 8 after the transferring is $OD_2$. The concentration of the toner is measured by using an optical tester X-Lite. The transfer efficiency is measured while changing a secondary transfer bias. Then, a result at the transfer bias when the transfer efficiency is the maximum is adopted. Further, if the transfer efficiency is 90% or higher, the transfer efficiency is determined to be good. On the other hand, if the transfer efficiency is lower than 90%, the transfer efficiency is determined to be bad.

Method of Determining Image Deviation

Figure 9:
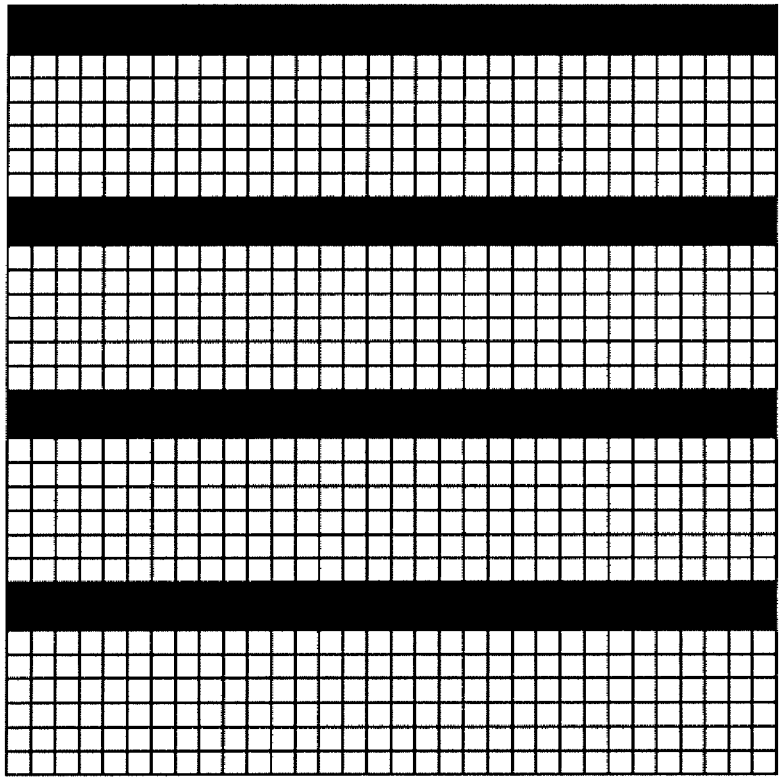
FIG. 9 is a view illustrating an image pattern used for evaluating image deviation in Examples.

Image deviation is determined for a horizontal line image of two dots which extends in the direction orthogonal to the movement direction (horizontal direction in FIG. 9) of the transfer material as shown in FIG. 9. In this case, one dot is a constituent of 1200 DPI≈21 μm×21 μm. The horizontal line image is transferred onto the above two types of transfer materials. If rubbed marks are not visually recognized on the horizontal line image transferred onto the transfer material, it is determined that the image deviation is not caused and the image is good. On the other hand, if such rubbed marks are visually recognized on the horizontal line image transferred onto the transfer material, it is determined that the image deviation is caused and the image is bad.

Individual Matters in Examples 1 to 4

Example 1

The pressure-contact nip width $W_1$ is 4 mm and the contact nip width $W_2$ is 1.9 mm. Therefore, $W_2<(W_1/2)$ is satisfied. The width of the secondary transfer nip 11*c* in the transfer material movement direction is 5.9 mm. The radius $R_1$ of the secondary transfer roller 12 is 40 mm and the radius $R_2$ of the intermediate transfer belt driving roller 9 (backup roller) is 32 mm. Therefore, $R_2<R_1$ is satisfied. The thickness of the elastic layer 12*b* (rubber layer) of the secondary transfer roller 12 is 2.5 mm and the thickness of the elastic layer (rubber layer) of the intermediate transfer belt 8 is 250 μm. The pressure load of the secondary transfer roller 12 onto the intermediate transfer belt driving roller 9 (backup roller) is 80 kgf.

An evaluation result in Example 1 is shown in Table 1 below.

TABLE 1

| | 2 × 2 dots | 8 × 8 dots | solid |
|---|---|---|---|
| Coated paper | 94.3% | 96.1% | 99.4% |
| Uncoated paper | 93.1% | 95.5% | 97.8% |

As shown in Table 1, the transfer efficiency was 90% or higher in both of the coated paper and the uncoated paper for all of the 2×2 dot image, the 8×8 dot image and the solid image. Accordingly, it is determined that excellent transfer efficiency was obtained in Example 1. Further, it is determined that image deviation was not caused in both of the coated paper and the uncoated paper because the rubbed marks in the horizontal image were not recognized.

Example 2

The pressure-contact nip width $W_1$ is 3 mm and the contact nip width $W_2$ is 0.2 mm. Therefore, $W_2<(W_1/2)$ is satisfied. The width of the secondary transfer nip 11*c* in the transfer material movement direction is 3.2 mm. The radius $R_1$ of the secondary transfer roller 12 is 40 mm and the radius $R_2$ of the intermediate transfer belt driving roller 9 (backup roller) is 24 mm. Therefore, $R_2<R_1$ is satisfied. The thickness of the elastic layer 12*b* (rubber layer) of the secondary transfer roller 12 is 5 mm and the thickness of the elastic layer (rubber layer) of the intermediate transfer belt 8 is 150 μm. The pressure load of the secondary transfer roller 12 onto the intermediate transfer belt driving roller 9 (backup roller) is 30 kgf.

An evaluation result in Example 2 is shown in Table 2 below.

TABLE 2

| | 2 × 2 dots | 8 × 8 dots | solid |
|---|---|---|---|
| Coated paper | 92.2% | 95.3% | 98.2% |
| Uncoated paper | 90.9% | 92.6% | 96.7% |

As shown in Table 2, the transfer efficiency was 90% or higher in both of the coated paper and the uncoated paper for all of the 2×2 dot image, the 8×8 dot image and the solid image as in Example 1. Accordingly, it is determined that excellent transfer efficiency was also obtained in Example 2. Further, it is determined that image deviation was not caused in both of the coated paper and the uncoated paper because the rubbed marks in the horizontal image were not recognized.

Example 3

The pressure-contact nip width $W_1$ is 8 mm and the contact nip width $W_2$ is 0.5 mm. Therefore, $W_2<(W_1/2)$ is satisfied. The width of the secondary transfer nip 11*c* in the transfer material movement direction is 8.5 mm. The radius $R_1$ of the secondary transfer roller 12 is 240 mm and the radius $R_2$ of the intermediate transfer belt driving roller 9 (backup roller) is 67 mm. Therefore, $R_2<R_1$ is satisfied. The thickness of the elastic layer 12*b* (rubber layer) of the secondary transfer roller 12 is 1.5 mm and the thickness of the elastic layer (rubber layer) of the intermediate transfer belt 8 is 250 μm. The pressure load of the secondary transfer roller 12 onto the intermediate transfer belt driving roller 9 (backup roller) is 120 kgf.

An evaluation result in Example 3 is shown in Table 3 below.

TABLE 3

| | 2 × 2 dot | 8 × 8 dot | solid |
|---|---|---|---|
| Coated paper | 96.1% | 98.2% | 99.7% |
| Uncoated paper | 95.5% | 97.7% | 98.4% |

As shown in Table 3, the transfer efficiency was 90% or higher in both of the coated paper and the uncoated paper for all of the 2×2 dot image, the 8×8 dot image and the solid image as in Example 1 and Example 2. Accordingly, it is determined that excellent transfer efficiency was also obtained in Example 3. Further, it is determined that image deviation was not caused in both of the coated paper and the uncoated paper because the rubbed marks in the horizontal image were not recognized.

Example 4

The pressure-contact nip width $W_1$ is 11 mm and the contact nip width $W_2$ is 5 mm. Therefore, $W_2<(W_1/2)$ is satisfied. The width of the secondary transfer nip 11*c* in the transfer material movement direction is 16 mm. The radius $R_1$ of the secondary transfer roller 12 is 240 mm and the radius $R_2$ of the intermediate transfer belt driving roller 9 (backup roller) is 67 mm. Therefore, $R_2<R_1$ is satisfied. The thickness of the elastic layer 12*b* (rubber layer) of the secondary transfer roller 12 is 10 mm and the thickness of the elastic layer (rubber layer) of the intermediate transfer belt 8 is 350 μm. The pressure load of the secondary transfer roller 12 onto the intermediate transfer belt driving roller 9 (backup roller) is 60 kgf.

An evaluation result in Example 4 is shown in Table 4 below.

TABLE 4

| | 2 × 2 dots | 8 × 8 dots | solid |
|---|---|---|---|
| Coated paper | 93.3% | 95.8% | 99.4% |
| Uncoated paper | 91.6% | 93.1% | 97.1% |

As shown in Table 4, the transfer efficiency was 90% or higher in both of the coated paper and the uncoated paper for all of the 2×2 dot image, the 8×8 dot image and the solid image, as in Example 1 to Example 3. Accordingly, it is determined that excellent transfer efficiency was also obtained in Example 4. Further, it is determined that image deviation was not caused in both of the coated paper and the uncoated paper because the rubbed marks in the horizontal image were not recognized.

Note that in each of the above Examples 1 to 4, the contact nip width $W_2$ was set to be doubled compared to the pressure-contact nip width $W_1$ to evaluate the transfer efficiency and image deviation. Accordingly, the relationship between the pressure-contact nip width $W_1$ and the contact nip width $W_2$ is expressed as $W_1<W_2$ in Examples 1 to 4. As for the evaluation result in these cases, transfer efficiency was lowered in any cases. It is considered that this is because charges remaining on the transfer material and the intermediate transfer belt 8 on the contact nip 11*b* are relaxed as time passes and a sufficient electric field cannot be obtained as the contact nip width $W_2$ is larger. Further, image deviation was slightly observed in any cases. It is considered that this is because the intermediate transfer belt 8 bends relatively largely in the compression direction along the outer circumferential surface of the secondary transfer roller 12 as the contact nip width $W_2$ is larger. In such a manner, the bending direction of the surface of the intermediate transfer belt 8 changes at the secondary transfer nip 11*c*. Then, the surface speed of the intermediate transfer belt 8 changes between the pressure-contact nip 11*a* and the contact nip 11*b* to cause the image deviation.

It is noted that the transfer apparatus and the image forming apparatus according to the invention are not limited to those described in each of the above embodiments. For example, the image forming apparatus in each of the above embodiments is the image forming apparatus supporting four colors. However, the image forming apparatus may be an image forming apparatus supporting only one color. That means that various changes in design can be made within the range of the scope of the invention.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A transfer apparatus comprising:

a transfer belt that carries an image, and has an elastic layer;

a transfer roller that transfers the image from the transfer belt onto a transfer material, has an elastic layer, and forms a transfer nip portion;

a backup roller which is opposite to the transfer roller with the transfer belt therebetween, the transfer nip portion including a pressure-contact nip formed in an area where the transfer belt is in contact with the transfer roller and the backup roller by a pressure, and a contact nip formed in an area where the transfer belt is in contact with the transfer roller and is no contact with the backup roller, the pressure-contact nip being located before the contact nip in a moving direction of the transfer material, a length of the contact nip in a rotational direction of the transfer roller being smaller than half a length of the pressure-contact nip in the rotational direction of the transfer roller.

2. An image forming apparatus comprising:

a latent image carrier on which a latent image is formed;

a developing portion that develops the latent image with a developer;

a transfer belt that carries a image developed by the developing portion, the transfer belt having an elastic layer;

a transfer roller that transfers the image from the transfer belt onto a transfer material, has an elastic layer, and forms a transfer nip portion;

a backup roller which is opposite to the transfer roller with the transfer belt therebetween, and a fixing unit that fixes the image on the transfer material after the image is transferred to the transfer material, the transfer nip portion including a pressure-contact nip formed in an area where the transfer belt is in contact with the transfer roller and the backup roller by a pressure, and a contact nip formed in an area where the transfer belt is in contact with the transfer roller and is no contact with the backup roller, the pressure-contact nip being located before the contact nip in a moving direction of the transfer material, a length of the contact nip in a rotational direction of the transfer roller being smaller than half a length of the pressure-contact nip in the rotational direction of the transfer roller.

3. The image forming apparatus according to claim 2, wherein a radius of the transfer roller is larger than a radius of the backup roller.

4. The image forming apparatus according to claim 2, wherein a thickness of the elastic layer of the transfer roller is larger than the length of the contact nip in the rotational direction of the transfer roller.

5. A image forming apparatus comprising:

a transfer belt that carries an image, and has an elastic layer;

a transfer roller that transfers the image from the transfer belt onto a transfer material, has an elastic layer, and forms a transfer nip portion;

a backup roller which is opposite to the transfer roller with the transfer belt therebetween, the transfer nip portion including a pressure-contact nip formed in an area where the transfer belt is in contact with the transfer roller and the backup roller by a pressure, and a contact nip formed in an area where the transfer belt is in contact with the transfer roller and is no contact with the backup roller, a length of the contact nip in a rotational direction of the transfer roller being smaller than half a length of the pressure-contact nip in the rotational direction of the transfer roller, a thickness of the elastic layer of the transfer belt being smaller than the length of the contact nip in the rotational direction of the transfer roller.

6. The image forming apparatus according to claim 2, further comprising a transfer material gripping member that grips the transfer material, wherein the transfer roller has a circumferential surface and a concave portion on the circumferential surface, and the transfer material gripping member is arranged in the concave portion.

7. The image forming apparatus according to claim 2, wherein the transfer roller has nozzle holes that selectively adsorb and separate the transfer material by flow of air.

8. The image forming apparatus according to claim 2, further comprising a tension roller being arranged at a place after the transfer roller in the direction to apply pressure to the tension belt towards the transfer roller.

* * * * *